United States Patent [19]

Blight

[11] Patent Number: 4,476,446

[45] Date of Patent: Oct. 9, 1984

[54] IMPEDANCE MATCHING NETWORK FOR FIELD EFFECT TRANSISTOR

[75] Inventor: Ronald E. Blight, Framingham, Mass.

[73] Assignee: Raytheon Company, Lexington, Mass.

[21] Appl. No.: 522,552

[22] Filed: Aug. 12, 1983

Related U.S. Application Data

[63] Continuation of Ser. No. 295,978, Aug. 25, 1981, abandoned.

[51] Int. Cl.[3] ..... H01P 5/00

[52] U.S. Cl. ..... 333/32; 333/247; 333/33; 336/65

[58] Field of Search ..... 333/32, 247, 204, 33; 330/277

[56] References Cited

U.S. PATENT DOCUMENTS

| | | | |
|---|---|---|---|
| 4,004,256 | 1/1977 | Duncan | 333/32 |
| 4,243,947 | 1/1981 | Glennon | 330/277 X |
| 4,314,220 | 2/1982 | Ito et al. | 336/65 |
| 4,319,209 | 3/1982 | Hara | 336/136 X |

FOREIGN PATENT DOCUMENTS

| | | | |
|---|---|---|---|
| 105428 | 8/1980 | Japan | 333/32 |

OTHER PUBLICATIONS

Naster et al., *Silicon-on Sapphire Monolithic Microwave ICs,* IEEE Int'l. Solid-State Circuits Conference 1981, Session VII: Microwave Amplifiers, Feb. 19, 1981.

Basawapatna, *Design & Performance of a 2 to 18 Ghz Medium Power GaAs MESFET Amplifier,* Proc. of 8th European Microwave Conf., Sep. 4–8, 1978.

*Primary Examiner*—Paul L. Gensler

*Attorney, Agent, or Firm*—Denis G. Maloney; Richard M. Sharkansky; Joseph D. Pannone

[57] ABSTRACT

An impedance matching network for coupling a microwave transmission line to a field effect transistor (FET). The impedance matching network includes a resistor coupled in shunt with the FET and an inductor connected between the microwave transmission line and the resistor. The inductor is formed by wrapping a conductive wire around a post inserted into a hole formed in a support for the FET.

4 Claims, 4 Drawing Figures

IMPEDANCE MATCHING NETWORK FOR FIELD EFFECT TRANSISTOR

This application is a continuation of application Ser. No. 295,978 filed Aug. 25, 1981, now abandoned.

BACKGROUND OF THE INVENTION

This invention relates to impedance matching networks and more particularly to an impedance matching network used for coupling a microwave transmission line to a field effect transistor (FET).

As is known in the prior art, the application of a field effect transistor amplifier for a multioctive bandwidth application presents severe impedance matching problems when the amplifier is used with a microwave transmission line becuase of the reactive characteristics of the input impedance of the FET. If the impedance matching over a broadband of frequencies is attempted with purely reactive elements to compensate for the impedance of the FET, as by a plurality of series and parallel connected reactive elements, the gain of the amplifier will not generally be uniform over the entire operating bandwidth. One technique for impedance matching using a pure passive element is suggested in an article entitled "Device-Circuit Considerations in the Design of Broadband MESFET Amplifiers, by Ganesh R. Basawapatna, published in conference record of the *Eleventh Annual Asilomar Conference On Circuits, Systems and Computers,* papers presented Nov. 7–9, 1977. The technique suggested in this article consists of placing a resistor between the gate and source electrodes of an FET. While this technique achieves a useful degree of impedance matching especially when the resistance of the resistor is relatively low, in the order of 200 ohms, nevertheless a severe loss of gain may result from the use of a pure resistive load.

Further, manufacturing difficulties may be encountered in fabricating reactive elements, such as an inductor as a part of the compensating network. In particular, an inductor for use in microwave frequency circuits may generally be realized as a coiled inductor, a one mil etched line on a semi-insulating substrate, or as a bond wire. Generally, a preformed coiled inductor is used to realize a coiled inductor in a microwave frequency circuit. A preformed coiled inductor may be unsatisfactory for some applications because the inductor may receive deformation forces due to handling and bonding to the circuit elements. The changes in the electrical characteristics of the inductor which may result include an increase in the tolerance of the inductance, decrease in the degree of reproducibility of an inductor having a desired inductance value, and an increase in degree of unpredictability of parasitic capacitance and inductance resulting from a nonreproducible placement of the inductor in relation to other circuit elements.

SUMMARY OF THE INVENTION

In accordance with the present invention, an impedance matching network for coupling a microwave transmission line to a field effect transistor (FET) is provided, the impedance matching network includes a resistor coupled in shunt with the FET and an inductor connected between the microwave transmission line and the resistor. The inductor is formed by wrapping a conductive wire around a post inserted into an opening formed in a substrate which supports the FET.

With such an impedance matching circuit, the use of an inductor with the resistive load results in a relatively uniform gain over the operating bandwidth with relatively little loss of in gain. Further, the resulting inductor may be fabricated to a relatively tight tolerance and with relatively high degree of reproducibility. Further, a predictable spatial relationship to other circuit components may result, thus reducing the unpredictability of parasitic capacitance and inductance, normally associated with preformed or bond wire inductors.

BRIEF DESCRIPTION OF THE DRAWINGS

For a better understanding of the invention, reference is made in the following detailed description to the drawings, wherein.

DESCRIPTION OF THE PREFERRED EMBODIMENT

Figure 1:
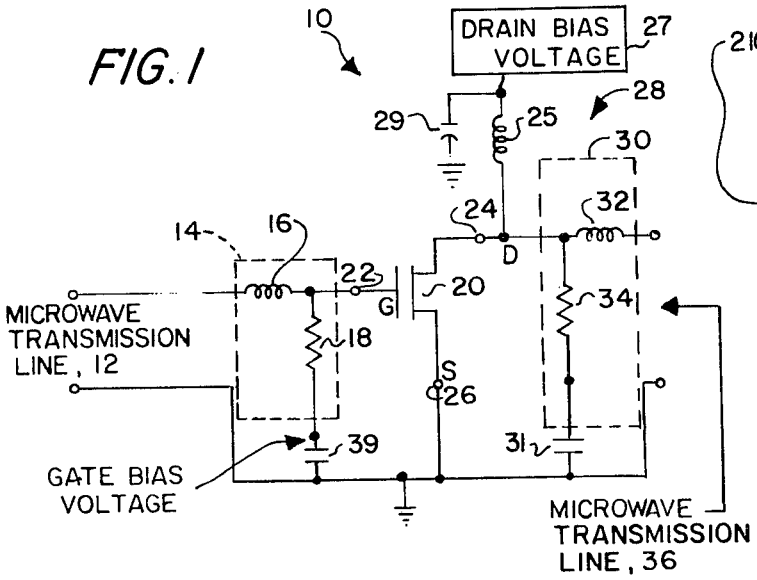
FIG. 1 is a schematic representation of a microwave circuit having a transmission line coupled to an FET through an impedance matching network in accordance with the present invention.

Referring now to FIG. 1, a microwave circuit here an amplifier 10 is shown having an input impedance matching network 14 for coupling an input microwave transmission line 12 to a field effect transistor 20 (FET), the FET 20 here being connected in a common (or grounded) source configuration, as shown. Impedance matching network 14 comprises a resistor 18 coupled in shunt with FET 20 and an inductor 16 coupled between microwave transmission line 12 and a gate electrode 22 of the FET 20. Resistor 18 is also coupled to a series D.C. blocking capacitor 39, here 20 pf which acts essentially as a short circuit over the frequency of operation here 2 GHz to 5 GHz. As shown in FIG. 1, an output impedance matching network 30 is provided to couple the source electrode 26 and drain electrode 24 of FET 20 to an output microwave transmission line 36. The output impedance matching network 30 includes a resistor 34 coupled in shunt with the drain electrode 24 and the source electrode 26 of FET 20 as shown, and an inductor 32 coupled between the end of the resistor 34 which is connected to drain electrode 24 and the output microwave transmission line 36, as shown. Resistor 34 is also coupled to a series D.C. blocking capacitor 31, here 20 pf, which acts essentially as a short circuit at the microwave frequencies in the frequency band of operation referred to above.

Still referring to FIG. 1, a drain bias network 28 is connected to the drain electrode 24 as shown. The drain bias network 28 here includes a series R.F. choke 25 connected to a drain bias voltage source 27, and the drain electrode 24, and a bypass capacitor 29 connected to the drain bias voltage source 27 and ground. The value of the capacitor 29 is here typically 20 pf. The series R.F. choke 25 is here chosen to have a high inductance, greater than 10 nh.

Figure 2:
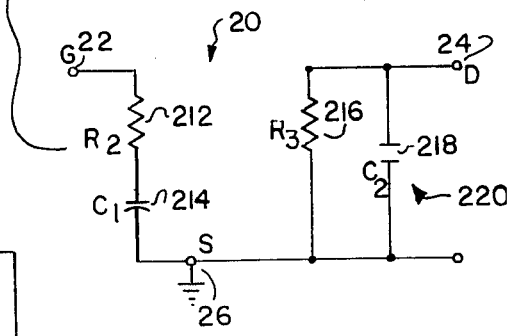
FIG. 2 is a schematic representation of the equivalent circuit of the FET used in the microwave circuit of FIG. 1.

In order to more fully understand the invention, reference is made to FIG. 2 which is an equivalent circuit of the FET 20. The equivalent circuit of the FET 20 is shown to include a first resistor 212 coupled in series to a first capacitor 214. This combination represents the equivalent circuit of the input impedance 210 of the common source connected FET 20, as measured between the gate electrode 22 and the source electrode 26. The equivalent circuit of the output impedance 220 of the FET 20 includes a resistor 216 coupled in parallel with a capacitor 218 which is coupled to the drain electrode 24 and the source electrode 26. Over the microwave frequency band of operation here 2 GHz to 5 GHz, the resistor 212 has a resistance of 9 ohms, the capacitor 214 has a capacitance of 0.7 pf, the resistor 216 has a resistance of 400 ohms, and the capacitor 218 has a capacitance of 0.15 pf.

Now referring to FIGS. 1 and 2, the input impedance of the microwave amplifier circuit 10 is a combination of the input matching circuit 14 and the input impedance 210 of the FET 20. To select the values of resistor 18 and inductor 16 a Smith Chart is first used to plot the input impedance for the combination of the FET 20 and the shunt resistor 18 over the frequency band of operation (here 2 GHz to 5 GHz) for various values of resistor 18. The determined impedance will have a real (i.e. resistive) component and a reactive (i.e. capacitive) component. The value for resistor 18 is chosen to achieve a desired voltage standing wave ratio (i.e. VSWR). The value for inductor 16, is then chosen to compensate for the reactive (i.e. capacitive) component of the Smith Chart determined impedance over the frequency band of operation. Using this procedure for a type 841D FET manufactured by Raytheon Company, Northboro, Mass., the value for resistor 18 is here in the range of 200–600 ohms with 400 ohms being a preferred value and the value for inductor 16 is here in the range of 0.5 nH to 1.5 nH with 0.9 nH being a preferred value. The input impedance matching circuit 14, having a resistor 18 of 400 ohms and an inductor 16 of 0.9 nH when coupled to the equivalent circuit input impedance 210 of FET 20 realizes a VSWR of better than 2:1 with respect to a microwave transmission line 12 having a characteristic impedance of 50 ohms.

Still referring to FIGS. 1 and 2, the output impedance of the microwave amplifier circuit 10 is the combination of the impedance matching circuit 30 coupled to the equivalent circuit output impedance 220 of FET 20. In a similar manner matching the transmission line 36 to the output impedance is achieved by determining a value for resistor 34 in accordance with the Smith Chart procedure described above in connection with the design of resistor 18 to achieve the desired VSWR. The value of inductor 32 is then chosen to remove any reactive component over the frequency band of operations. The impedance matching thus obtained provides an increase in the gain of the amplifier 10 because less energy will be reflected backward, towards the FET due to a better match of FET 20 to the microwave transmission line 36. Generally, for the values given above for resistor 216 and capacitor 218 for the equivalent circuit of the output impedance 220, the value of resistor 34 is here in the range of 200–600 ohms with 400 ohms being preferred, and the value for inductor 32 is here in the range of 0.5 nH to 1.5 nH with 0.9 nH being preferred. Given those values for resistor 34 and inductor 32, in combination with the values given for the equivalent circuit output impedance 220 of the FET 20, a VSWR of better than 2:1 is realized over a frequency band of 2 GHz to 5 GHz.

Figure 3:
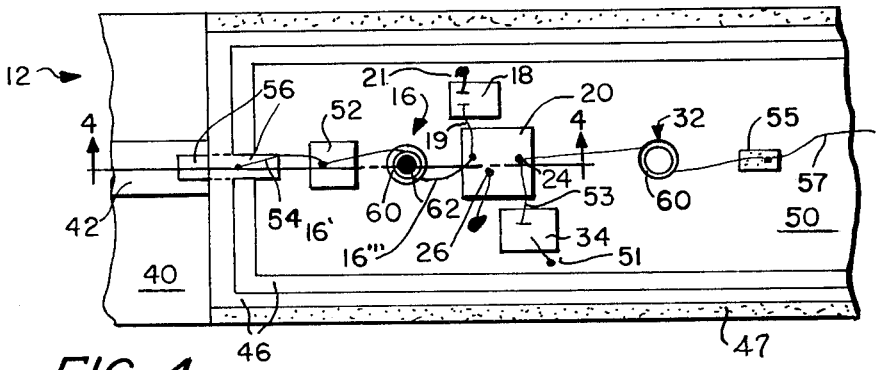
FIG. 3 is a topographical view of a preferred embodiment of the microwave circuit of FIG. 1.
Figure 4:
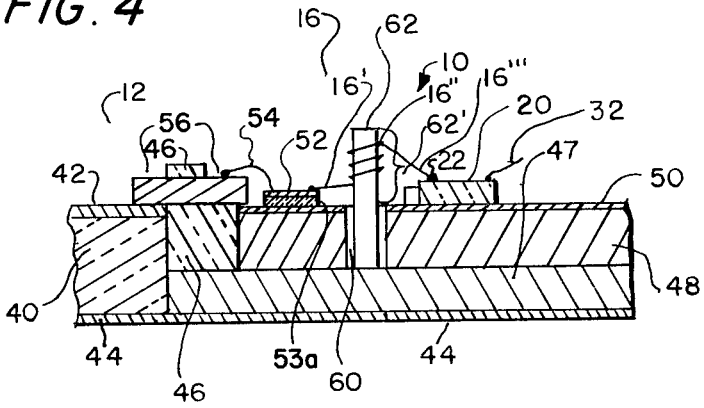
FIG. 4 is a cross-sectional view of the microwave circuit of FIG. 3 taken along the line 3—3 of FIG. 3.

Now referring to FIGS. 3 and 4, the amplifier circuit 10 is disposed on a conductive support 47 here gold plated Kovar Metal. Microwave transmission line 12 is here a 50 ohm microstrip transmission line having a strip conductor 42 preferably of gold and a ground plane 44 separated by a portion of a dielectric 40, here alumina as shown in FIG. 4. A ceramic frame 46 is disposed on the support 47 as shown. A conductive block 48, here of copper, is supported by the support 47. A thin conductive layer 50, here gold, is plated on the upper surface of the copper conductive block 48. Mounted to the gold plated copper block 48 are the impedance matching resistor 18, FET 20, impedance matching resistor 34, input conductive pad 52 spaced from layer 50 by a dielectric **52*a*, and output conductive pad 55, spaced from layer 50 by a dielectric (not shown). One end of the impedance matching resistor 18 is connected by a bonding wire 19 to the gate electrode 22 of FET 20 and the second end of the matching resistor 18 is connected by a bonding wire 21 to the gold layer 50 of plated copper block 48. All attachments of the circuit elements to the layer 50 of block 48 are made with conductor solder (not shown) or a conductive epoxy suitable for use at the operating frequencies. Gate electrode 22 of FET 20 is coupled to the input pad 52 through the inductor 16. The input pad 52 is connected to a gold ribbon 56, here five or six mils wide, via a conductive lead 54. The ribbon 56 passes through a hole formed in the ceramic support 46, as shown. The gold ribbon 56 is connected to the strip conductor 42 of the microwave transmission line 12 by a conductive solder (not shown). Inductor 16 is formed around a post 62 which is disposed in opening 60 formed in the block 48 in a manner to be explained in conjunction with FIG. 4. Suffice it to say here however that the impedance matching resistor 34 has one end connected with a bond wire 51 which is connected to the gold layer 50 of copper block 48 with conductive solder and has a second end connected by a bond wire 53 to the drain electrode 24 of FET 20. The output pad 55 is coupled to the drain electrode 24 of FET 20 through inductor 32. The output pad 55 is connected to the microwave transmission line 36 (not shown) by lead 57 in a manner similar to that disclosed above for connecting microwave transmission line 12. Inductor 32 may be formed in the manner similar to that used to form inductor 16 to be discussed in conjunction with FIG. 4**.

Use of resistors 18 and 34 and inductor 16 and 32 to couple microwave transmission lines 12 and 34 to FET 20 results in an amplifier with a VSWR of 2:1 over the frequency band of operation (here 2 GHz to 5 GHz). The gain of the microwave circuit 10, as shown in FIGS. 1–3, when using a gallium arsenide FET 20 type 841D manufactured by SMDO, Division of Raytheon Company, Northborough, Mass. was 7 db nominal over a frequency band of 2–5 GHz. This circuit maintains a 2:1 VSWR over the operating frequency range of 2 GHz to 5 GHz.

Now referring again to FIG. 4, the inductor 16 is formed over an aligning opening 60 in the gold plated copper block 48 as shown. Inductor 16 is a coiled inductor having a first end 16′ connected to the input pad 52 and having a second end 16‴ connected to the gate electrode 22 of FET 20. The coiled section 16″ of coiled inductor 16 is formed over the aligning opening 60. The aligning opening as shown in FIG. 4 is exaggerated in the size of the opening in relation to the post 62 which is inserted therein; the post 62 preferably being made to fit snuggly within the opening 60. The opening 60 preferably is made completely through the gold plated copper block 48. The inner opening formed by the coil 16'' is aligned coaxially with the center of the aligning opening 60.

The coiled inductor 16 is formed as follows: an aligning opening 60 of any arbitrary shape, preferably circular, and a diameter here of 0.013 inches is formed through the gold plated copper block 48 by mechanical drilling or other suitable means; post 62 of a ferromagnetic or low dielectric material, of suitable size and shape with regard to the aligning opening 60 is inserted within the aligning opening 60 with tweezers or other suitable means. The post 62 has a substantial portion 62' extending above the surface of the gold plated copper block 48; one end 16' of a bond wire, here a 1 mil wide gold bond wire, is bonded with a bonding tip, to here the input pad 52; a portion 16'' of the wire is wrapped around the contours of the post 62 with a hand held bond tool or the bonding tip to form a plurality of turns or at least a contour around the post 62; the bonding tool or bonding tip then overshoots the gate electrode 22 of FET 20 prior to bonding to the gate electrode 22, becaue when the bonding tool or bonding tip is removed, the formed coil 16'' will recoil back slightly and the coil 16'' diameter will increase slightly. The bonding tip is then used to bond the bond wire to the gate electrode 22 of FET 20 and any excess length of bond wire on the gate electrode 22 is cut. The post 62 is removed. Any conventional means, may be used to remove the post 62, such as a magnet or suction. Additionally, in some applications, it may be desirable to eliminate the step of removing the post 62 if a low dielectric material such as a quartz fiber is used for the post 62. Inductors realized with the post 62 left in the opening, however, will have larger variations in inductance from a predicted value due to the difficulty in achieving uniform windings around the post than inductors realized with the post 62 removed. The preferable method of post removal is by use of a magnet, thus implying that the preferable material for the post 62 is a ferromagnetic material. Post removal with the magnetic technique has been shown to impart a minimal amount of distorting force to the formed coil 16'' of the coiled inductor 16.

Having described preferred embodiments of the invention, it will now become readily apparent to those of skill in the art that other embodiments incorporating the concept of this invention may be realized. For example a plurality of the amplifier circuits may be cascaded together to provide a multioctave amplifier with high gain. In addition, the matching circuits described are useful for other applications besides an amplifier. For example, the structure may be used to match a microwave transmission line to a dual gate FET for switching applications. It is felt, therefore, that this invention should not be limited to the disclosed embodiment but rather should only be limited to the scope an spirit of the claims.

What is claimed is:

1. An impedance matching network comprising:

a support having an alignment opening therein;

a field effect transistor disposed on a surface of the support;

a resistor disposed on said surface of the support and coupled in shunt with a pair of electrodes in the field effect transistor;

a microwave transmission line; and an inductor comprising a length of a wire coiled about a region, the coiled portion of the wire aligned over the alignment opening, and having a pair of ends disposed over the surface, a first end electrically coupled to a first one of the electrodes of the pair of electrodes of the field effect transistor and having a second end electrically coupled to the microwave transmission line.

2. The network as recited in claim 1 wherein said coiled portion is freely suspended over the alignment opening and has an air core.

3. The network as recited in claim 1 further comprising a low dielectric member disposed through the coiled portion of the wire and the opening in the support.

4. A microwave circuit comprising:

a base having a conductive layer disposed on a first surface thereof;

a microwave transmission line including a strip conductor portion dielectrically spaced from a ground plane conductor portion, said ground plane conductor portion of the microwave transmission line being connected to said conductive layer of said base;

a support disposed on the base having an alignment opening;

a plurality of electrically interconnected microwave components disposed on a surface of said support, said components including a field effect transistor and a resistor, said resistor having a first end connected to a gate electrode of the field effect transistor and a second end coupled to a reference potential; and an inductor comprising a length of wire coiled about a region, said coiled portion of the wire aligned over the alignment opening and having a first end electrically coupled to said gate electrode and a second end electrically coupled to the strip conductor of the microwave transmission line.

* * * * *